United States Patent [19]

Maus

[11] 4,428,279

[45] Jan. 31, 1984

[54] VENTILATION REGISTER

[75] Inventor: Julius Maus, Stuttgart, Fed. Rep. of Germany

[73] Assignee: Gretsch-Unitas GmbH, Fed. Rep. of Germany

[21] Appl. No.: 300,908

[22] Filed: Sep. 10, 1981

[30] Foreign Application Priority Data

Sep. 15, 1980 [DE] Fed. Rep. of Germany ..... 3034765

[51] Int. Cl.[3] ..... E06B 7/082

[52] U.S. Cl. ..... 98/98; 49/38; 49/DIG. 1; 98/88 R; 98/99.6

[58] Field of Search ..... 49/38, 61, DIG. 1; 52/403; 98/41 SV, 88 R, 98, 99 R, 99.6, 99.8, 114

[56] References Cited

U.S. PATENT DOCUMENTS

| | | | |
|---|---|---|---|
| 2,151,231 | 3/1939 | Randall et al. | 49/61 |
| 3,094,058 | 6/1963 | O'Brien, Jr. et al. | 49/38 X |
| 3,509,812 | 5/1970 | James | 98/114 X |

FOREIGN PATENT DOCUMENTS

| | | | |
|---|---|---|---|
| 1151910 | 7/1963 | Fed. Rep. of Germany | 98/88 R |
| 1934996 | 1/1971 | Fed. Rep. of Germany | 98/99 R |
| 2038384 | 2/1972 | Fed. Rep. of Germany | 98/88 R |
| 2261822 | 1/1974 | Fed. Rep. of Germany | 98/114 |
| 7906375 | 2/1981 | German Democratic Rep. | 49/38 |
| 916420 | 1/1963 | United Kingdom | 98/88 R |

*Primary Examiner*—William E. Wayner
*Assistant Examiner*—Harold Joyce
*Attorney, Agent, or Firm*—McGlew and Tuttle

[57] ABSTRACT

To avoid or at least substantially reduce heat losses occurring with conventional registers ventilation, a register is disclosed which is assembled of two basic bodies supporting each a shutter and connected to each other through a thermally insulating layer. Preferably, the thermally insulating layer comprises insulating sectional strips and it is satisfactory to provide such strips only along the upper and lower longitudinal edges of the two basic bodies. The two shutters are coupled to each other so that they can be shifted conjointly from their closing to their open position and vice versa by means of a single drive mechanism.

20 Claims, 1 Drawing Figure

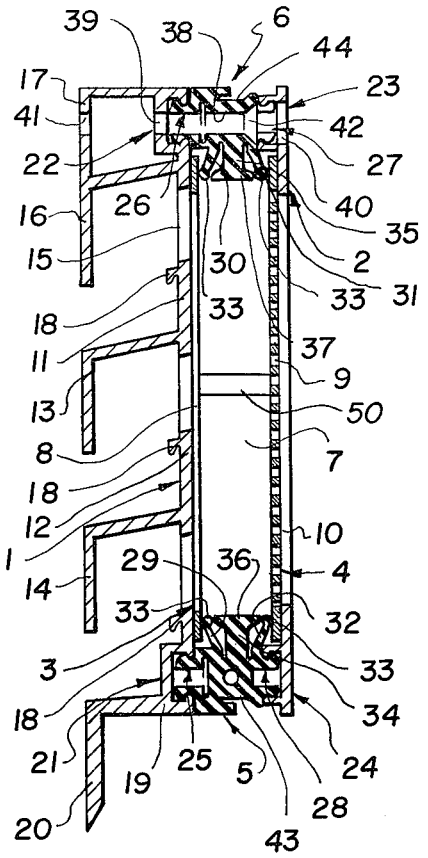
39
38
6
44
17
23
41
42
22
27
26
40
16
35
15
30
2
33
31
18
33
11
37
9
13
50
8
7
18
12
10
1
29
36
4
14
33
32
3
33
18
34
21
25
5
24
19
28
20
43

VENTILATION REGISTER

FIELD AND BACKGROUND OF THE INVENTION

The present invention relates to a new and useful ventilation register.

Registers are usually made up of a basic body and a shutter mounted thereon, with both the basic body and the shutter being provided with a plurality of ventilation apertures which are juxtaposed in the displacement direction of the shutter and, as a rule, are of equal size, with cover lands extending therebetween. In one end position of the shutter, the lands of the basic body are aligned with the ventilation apertures so that no air can pass therethrough. In the other end position of the shutter, the ventilation apertures of the basic body are aligned with rows of apertures of the shutter, so that a maximum passage area is open for the air. In intermediate positions of the shutter, the ventilating effect is correspondingly smaller.

Prior art ventilation registers are made, as a rule, of aluminum, with preferably suitable aluminum sections being employed for both the basic body and the shutter. The back and forth movement of the shutter is effected by means of a drive mechanism which is secured to the basic body and, preferably, engages by its drive member into at least one of the ventilation apertures of the shutter.

As is well known, aluminum is a good heat conductor. Therefore, ventilation registers of this kind cause appreciable losses of heat even when closed to air flow.

SUMMARY OF THE INVENTION

The invention is directed to a ventilation register in which such heat losses are substantially reduced.

To this end and in accordance with the invention, a ventilation register is provided comprising two basic bodies which are connected to each other through an insulating layer and each supporting a ventilating shutter. Due to this insulating layer, the cold bridge of prior art ventilation registers is avoided. Therefore, the heat losses in the inventive register are substantially reduced. In addition, with the ventilation closed, an air cushion or dead air space is formed between the two basic bodies or between the shutters if they are inside, which further suppresses the heat exchange between the warmer inner space and the colder air outside.

Further, a draft development observed in prior art ventilation registers, is at least largely eliminated in the inventive register, due to the mentioned air cushion. In view of these advantages and, particularly, also the involved high expenditures of energy, the somewhat higher costs of manufacturing the inventive register recede into the background.

In a particularly preferred embodiment of the invention, the ventilation shutters are coupled to each other and displaceable simultaneously and in the same direction so that both shutters come into the completely closed or completely open position at the same time. The same, of course, applies to any intermediate position.

A development of the invention provides that the insulating layer has the shape of strips or a kind of sectional or profiled strips which are placed each at least between the two longitudinal edge portions of the basic bodies. At the two transverse edge portions, the sealing may be effected by the drive mechanism, on the one hand, and an end piece, on the other hand, with proper insulating inserts for preventing cold bridges being provided at these sides too.

A preferred development of the ventilation register with insulating sectional strips, provides that the insulating sectional strips are connected to the basic bodies by snap action or interlocking means. This simplifies not only the assembly, but also maintenance and repair. In addition, the manufacturing costs can be reduced if the locking or snap elements are formed or molded integrally with or similarly secured to the basic bodies, on the one hand, and the insulating sectional strips on the other hand.

Accordingly an object of the present invention is to provide a ventilation register which reduces heat loss and is formed of two spaced apart body members each having a movably mounted shutter thereon for selectively opening and closing an opening in each body member, said body members connected to each other by at least one insulation connector member connected therebetween.

A further object of the invention is to provide a ventilation register which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF DRAWINGS

In the Drawings:

The single drawing is a vertical sectional view of an inventive ventilation register with horizontally moving shutters.

DESCRIPTION OF PREFERRED EMBODIMENT

The register substantially comprises two bodies 1, 2, shutters 3, 4 which are mounted thereon for displacement perpendicularly to the drawing plane, and two insulating sectional strips 5, 6 by which basic bodies 1, 2 are connected to each other in a heat insulating manner while forming a chamber 7 therebetween. At the two narrow sides of the register, the chamber is closed by means of end pieces (not shown) of which one may be designed additionally, as a drive element. Such a drive element is connected to the two shutters 3, 4 which are provided at the inside, or to a coupling member 50 inserted therebetween, so that the shutters can be moved simultaneously and in the same direction. In the embodiment shown, shutter 3 is provided with conventional, substantially rectangular ventilation slots 8, while shutter 4 is designed with ventilation apertures arranged in groups of small ventilation holes 9. These groups form a system of longitudinal and transverse rows of holes, extending approximately over the area of one ventilation slot 10 of basic body 2. The lands between ventilation slots 10 or between the ventilation hole groups of shutter 4, correspond in extension about to the width of ventilation slot 10.

The ventilation slots of basic body 1, in the embodiment shown, are trisected by two webs 11 and 12. An angled weather strip 13, 14, which is slightly slanting and extends outwardly then downwardly, is connected to each of the two webs. Above the uppermost partial ventilation slot 15, another weather strip 16 is provided which is directly connected to a reinforcing angle 17. A drip lip 18 is provided on the lower end of each of the partial ventilation slots. On its lower longitudinal edge portion 19, basic body 1 supports an angled, preferably rectangular, glass pane stop flange 20. A register of such design is suitable for being seated on top of a pane, preferably insulating glass pane, i.e. this register is intended for being engaged into a glass groove. However, this design is not limited to such application, and with a slight modification, particularly on the upper and lower longitudinal edge, the register may also be used as a conventional frame ventilator or in a wall opening.

The two basic bodies 1, 2, as already mentioned, are connected to each other through an insulating layer intended for preventing or at least rendering more difficult a heat convection from one basic body to the other and comprising, in the embodiment shown, two insulating sectional strips 5, 6 provided at the upper and lower longitudinal edge portions of the two basic bodies. As may be learned from the drawing, the sectional strips are of quite particular shape, which also permits connection of the basic bodies 1, 2 to the intermediate sectional strips 5, 6 by shapping or interlocking. For this purpose, locking sockets 21, 22 and 23, 24 having a U-shape cross-section are provided on the upper and lower longitudinal edge portions of the two basic bodies. Each of these sockets is interlockable with a locking member 25, 26 and 27, 28 of the associated insulating sectional strip 5, 6 which also is substantially U-shaped. The free ends of the U-legs of both the locking sockets and the locking members are formed with locking beads which engage each other from behind, as shown in the drawing.

Guides known per se (not shown) for the two shutters 3, 4 may be provided on basic body 1 or 2. In addition, or as an alternative, seal strips 29, 30 and 31, 32 may be provided, which apply against the insides of the shutter 3, 4. In the shown embodiment, the seal strips are formed integrally with the two insulating sectional strips 5, 6 which, preferably, are identical in design and mounted in mirror-inverted positions in the register. The seal strips extend in a plane inclined relative to that of shutters 3, 4 and are intended to press the shutters against the inside surface of the respective basic body and thus to reduce their sliding fit. The seal strips must therefore be sufficiently elastic. On the other hand, their free portions or sealing lips are exposed to a certain friction during the operation of the shutters and must be relatively resistant, at least in this sealing lip portion. For this reason, it is provided in accordance with a further development of the invention, that each seal strip 29, 30 and 31, 32 is designed as a so-called hard-soft seal strip having its free end 33 applying against the shutter, made of a hard material, and as for the rest, being made of a softer material of proper elasticity. A suitable elastomer therefore can be used. A preferred design of the seal lip 33 is a slightly thickened portion, particularly having a circular cross-section.

The webs of the two locking members 25 and 28 of strip 5 and 26 and 27 of strip 6 are connected to each other, preferably integrally, by means of an intermediate member 34 and 35, respectively, having a substantially T-shaped cross-section. The T-shaped flanges 36, 37 of the member 34, 35 serve as abutments for the seal strips extending adjacently and at both sides, particularly for the free end portions or lips 33 thereof. This design makes it possible to omit separate guides on basic body 1, 2 for shutters 3, 4.

The two insulating sections or profiled strips 5, 6 are provided with a plurality of laterally spaced apart mounting holes 38 which are aligned with corresponding holes or bores 39, 40 of the two basic bodies 1, 2. The axis of mounting holes 38 lie in the central plane of U-shaped locking members 25 to 28. If a reinforcing angle 17 is used, the vertical leg thereof is provided with a bore 41 which is aligned with the mentioned other bores. Through all these holes or bores, the inventive ventilation register can be screwed to a supporting structure (not shown) such as a window frame or the like. The ends close to basic body 2 of mounting hole 36 are enlarged to receive the screw heads. This provides for a thermal insulation of the screws, so that in this zone again, cold bridges are absent. This countersink is shown at 42. Each of the two insulating sectional strips 5, 6 is formed on its outside longitudinal edge with a mounting groove 43, 44 of substantially angular section, for a glass pane stop (not shown). A thermal separation and advantageous design in accordance with the objective of the invention is thereby obtained also in this area.

The special design of shutter 4 in itself already prevents flies and other vermin from passing therethrough. However, one or two fly screens (not shown) secured in a known manner, may be provided in addition. This will particularly be the case if shutters with conventional rectangular ventilation slots are employed.

While a specific embodiment of the invention has been shown and described in detail to illustrate the application of the principles of the invention, it will be understood that the invention may be embodied otherwise without departing from such principles.

What is claimed is:

1. A ventilation register comprising:

a first body member having at least one opening therein;

a first shutter member slidably mounted to said first body member and having at least one opening therethrough selectively alignable and disalignable with said at least one first body member opening for selectively opening and closing said first body member opening;

a second body member having at least one opening therethrough;

a second shutter member slidably mounted to said second body member and having at least one opening therethrough selectively alignable and disalignable with said at least one second body member opening for selectively opening and closing said second body member opening;

drive means connected to said first and second shutter members for displacing said first and second shutter members substantially simultaneously in the same direction;

at least two insulation connector members connected between said first and second body members adjacent opposite longitudinal edges of said first and second body members for holding said first and second body members together and defining a space therebetween;

each of said insulation connector members having a portion made of insulating material bearing against a respective shutter for holding each respective shutter against its respective body member to which it is movably mounted.

2. A ventilation register according to claim 1, wherein each of said insulation connector members comprises an insulation strip having a profiled cross-section, with snap action interlocking means connected between each of said strips and each of said body members for interlocking said body members to said strips.

3. A ventilation register according to claim 2, wherein said snap action interlocking means comprises a substantially U-shaped socket on each of said body members for each of said strips and substantially U-shaped projections extending from each of said strips and into each of said U-shaped sockets.

4. A ventilation register according to claim 3, wherein each of said sockets and each of said projections include interlocking beads for engaging each of said projections into each of said sockets respectively.

5. A ventilation register according to claim 1, including a weather strip extending from said first body member in a direction opposite the space between said first and second body members for partially covering said at least one first body member opening.

6. A ventilation register according to claim 5, wherein said weather strip is an angled member extending first out from said first body member and then down over said first body member opening.

7. A ventilation register according to claim 1, wherein said second body member includes a plurality of apertures arranged in groups which are covered and uncovered by said second shutter, by movement of said second shutter with respect to said second body member.

8. A ventilation register according to claim 1, wherein each of said insulation connector members includes a mounting groove defined therein on a longitudinal edge of each insulation connecting member opposite the space between said first and second body members, having a substantially angular cross-section for receiving a planar flange member.

9. A ventilation register according to claim 2, wherein each strip includes a plurality of laterally spaced mounting holes extending therein, each of said body members including holes aligned with said strip holes.

10. A ventilation register according to claim 9, wherein each strip hole is countersunk.

11. A ventilation register comprising:

a first body member having at least one opening therein;

a first shutter member slidably mounted to said first body member and having at least one opening therethrough selectively alignable and disalignable with said at least one first body member opening for selectively opening and closing said first body member opening;

a second body member having at least one opening therethrough;

a second shutter member slidably mounted to said second body member and having at least one opening therethrough selectively alignable and disalignable with said at least one second body member opening for selectively opening and closing said second body member opening;

drive means connected to said first and second shutter members for displacing said first and second shutter members substantially simultaneously in the same direction;

at least two insulation connector members connected between said first and second body members adjacent opposite longitudinal edges of said first and second body members for holding said first and second body members together and defining a space therebetween;

each insulation connector member including an elastic sealing portion extending obliquely toward the plane of a respective shutter for holding each respective shutter against its respective body member to which it is movably mounted.

12. A ventilation register according to claim 11, wherein each sealing portion is made of material which is hard in the area thereof intended to come into contact with each shutter, and soft elsewhere in the sealing portion.

13. A ventilation register according to claim 12, wherein said sealing portions are made of plastic.

14. A ventilation register according to claim 11, wherein each sealing portion is thicker at an end thereof away from the remainder of its respective member.

15. A ventilation register according to claim 14, wherein said thicker end of each sealing portion is circular in cross section.

16. A ventilation register according to claim 11, wherein each insulation connector member includes a web portion and a substantially T-shaped intermediate portion having a base connected to said webs and a flange abutting each sealing portion of a respective member.

17. A ventilation register according to claim 16, wherein said flange of each T-shaped portion engages a free end of each sealing portion, each sealing portion having a free end with an enlarged cross-section.

18. A ventilation register comprising:

a first body member having at least one opening therein;

a first shutter member movably mounted to said first body member for selectively opening and closing said body member opening by movement thereof;

a second body member having at least one opening therein;

a second shutter member movably mounted to said second body member for selectively opening and closing said second body member opening by movement thereof; and at least two insulation connector members connected between said first and second body members adjacent opposite longitudinal edges of said first and second body members;

each of said insulation connector members comprising an insulation strip having a profiled cross-section, with snap action interlocking means connected between each of said strips and each of said body members for interlocking said body members to said strips;

said snap action interlocking means comprising a substantially U-shaped socket on each of said body members for each of said strips and substantially U-shaped projections extending from each of said strips and into each of said U-shaped sockets; each of said sockets and each of said projections including interlocking beads for engaging each of said projections into each of said sockets respectively;

each strip including an elastic sealing portion extending obliquely toward the plane of a respective shutter for holding each respective shutter against its respective body member to which it is movably mounted.

19. A ventilation register according to claim 18, wherein each sealing portion is made of material which is hard in the area thereof intended to come into contact with each shutter, and soft elsewhere in the sealing portion.

20. A ventilation register according to claim 18, wherein each of said U-shaped projections of each strip respectively includes a web portion, with web portions of each strip connected to and formed integrally with a substantially T-shaped intermediate portion having a base connected to said webs and a flange abutting each sealing portion of a respective member.

* * * * *